United States Patent [19]

Biagiotti

[11] Patent Number: 5,031,850

[45] Date of Patent: Jul. 16, 1991

[54] REWINDING MACHINE FOR THE FORMATION OF ROLLS OF PAPER OR THE LIKE

[75] Inventor: Guglielmo Biagiotti, Lucca, Italy

[73] Assignee: Perini Finanziaria, Lucca, Italy

[21] Appl. No.: 488,981

[22] Filed: Mar. 5, 1990

[30] Foreign Application Priority Data

Mar. 9, 1989 [IT] Italy ..... 9363 A/89

[51] Int. Cl.[5] ..... B65H 19/28

[52] U.S. Cl. ..... 242/66; 242/56 R

[58] Field of Search ..... 242/56 R, 56 A, 56.6, 242/66

[56] References Cited

U.S. PATENT DOCUMENTS

| | | | |
|---|---|---|---|
| 4,327,877 | 5/1982 | Perini | 242/66 |
| 4,828,195 | 5/1989 | Hertel et al. | 242/66 |
| 4,909,452 | 3/1990 | Hertel et al. | 242/56 R |

*Primary Examiner*—John M. Jillions
*Attorney, Agent, or Firm*—Francis J. Bouda

[57] ABSTRACT

A rewinder for converting large supply rolls of paper into smaller rolls such as toilet tissue and kitchen towels includes a pair of winding cylinders, the surfaces of which are spaced slightly apart to create a nip therebetween. The cylinders rotate in the same direction, so as to create opposing surface movement in the area of the nip. A web of paper enters the nip and crosses therethrough from one winding cylinder to the other, passing firstly the winding cylinder, the surface of which is moving in a direction opposite to the incoming direction of the web. A core on which the web is to be wound is to be inserted into the nip, pinching web between the first winding roll, causing a reverse movement in the direction of the web and separating the web in the nip between the two winding cylinders. The core has adhesive on its surface which contacts the web and causes the leading edge of the web to fold back upon itself and wind up on the core under the action of the second winding cylinder to create a small log or roll of paper on the core in the space between the two winding cylinders. The invention includes means for taking up the slack in that portion of the advancing web immediately in front of the winding cylinder during the period when the leading edge of the web folds back upon itself and before it begins to wind up on the core under the action of the second winding cylinder.

9 Claims, 3 Drawing Sheets

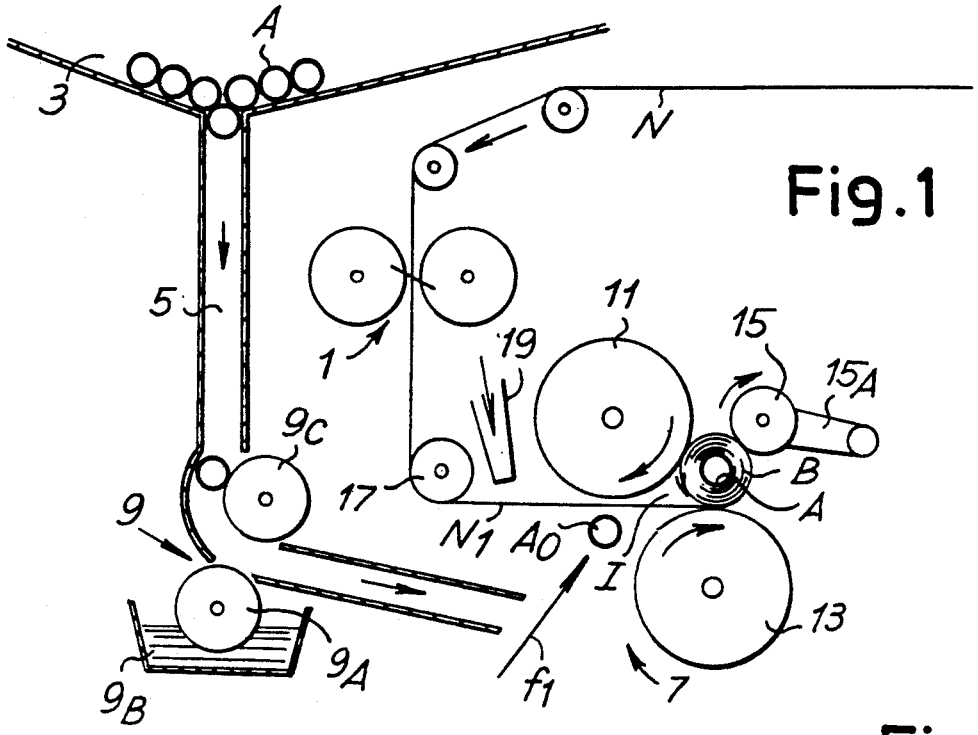
Fig.1
Fig. 3
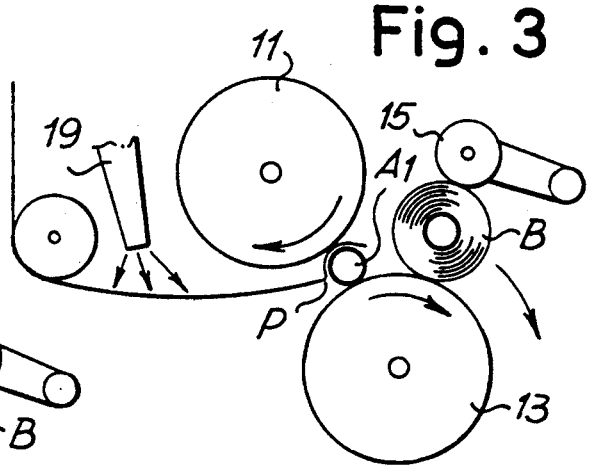
Fig.2
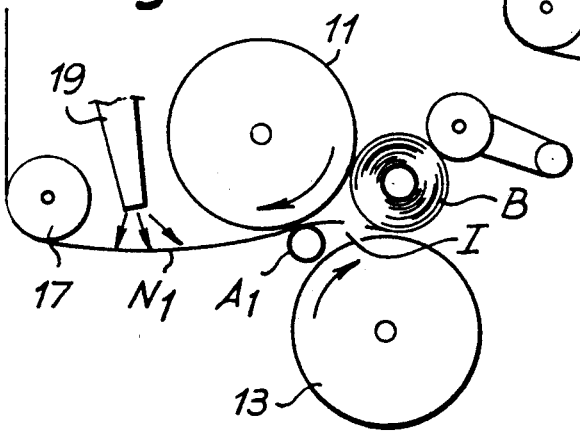
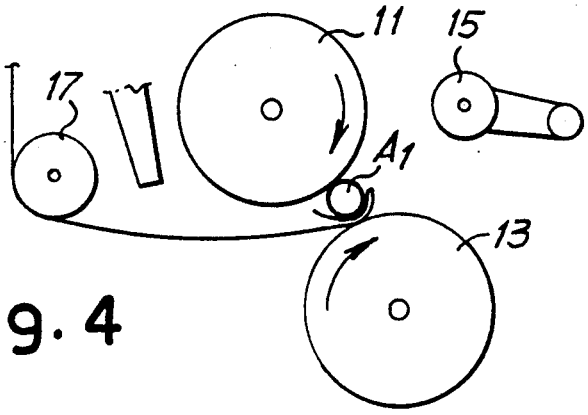
Fig. 4

REWINDING MACHINE FOR THE FORMATION OF ROLLS OF PAPER OR THE LIKE

SUMMARY OF THE INVENTION

The invention relates to a rewinding machine for the formation of rolls or logs of paper or the like, especially for the formation of small rolls made of detachable segments or sheets of paper, such as toilet tissue, kitchen towels or the like. It comprises an upper winding cylinder, a lower winding cylinder forming a nip with the upper cylinder, a third movable roller which defines with said two cylinders, the space for the winding of a roll. It also includes means for the insertion of individual cores into said nip and means for wetting the cores with adhesive. The relative peripheral speed between said cylinders may be cyclically variable.

An object of the invention is to provide a fast and reliable machine for the formation of logs, and thus of small rolls, with a precise number of segments or sheets of paper and with a very regular winding start. These and other objects and advantages will be evident from a reading of the following description.

According to the invention:

the incoming web crosses the nip between the two winding cylinders;

the feed direction of the web arriving at said nip is opposite to the rotation direction of the winding cylinder with which it comes in contact during the insertion of the core into said nip, thereby causing the tear of the web during said insertion; and the leading edge of the web is secured to the core by means of adhesive and is folded up by having it wedged between the core and the other of said winding cylinders.

Other characteristics of the invention will be apparent by the dependent claims.

DETAILED DESCRIPTION

The invention will be better understood by the following description and the attached drawing, which shows a practical, non-limiting example of the same invention. In the drawings, wherein like reference characters indicate like parts:

FIGS. 1 to 4 show schematically an embodiment of the invention in four successive stages of completion of winding of a roll on one core and start of winding of another roll on a succeeding core.

Figure 5:
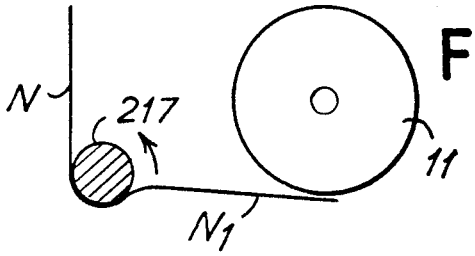
FIGS. 5 and 6 show additional embodiments similar to that shown in FIG. 4.

Referring now particularly to FIG. 1 but also FIGS. 2 to 4, N indicates the paper web is continuously fed from a supply roll (not shown) to be wound up in successive rolls or logs B on cores A. The web-like material is fed continuously during the replacement of a core, on which the desired amount of web material has been wound, with another core on which a new winding operation must start. The web N passes through a perforating station 1 where it is traversely perforated at regular distances to provide individual sheets of paper (as in a toilet tissue roll or a roll of kitchen towels). Numeral 3 indicates a reservoir of tubular cores A, which is combined with a guide system 5 to move the cores towards the re-winder 7, passing through an adhesive wetting system, generally indicated by 9, and which may include, for example, a roller 9A rotating in a bath of fluid adhesive in a basin 9B located beneath the counteracting roller 9C. This is only an exemplary representation of one known system for feeding the tubular cores made of cardboard or similar material to the rewinder 7.

The rewinder 7 includes a first upper winding cylinder 11 and a second lower winding cylinder 13, between which there is defined a nip which, in the narrowest zone, is slightly narrower than the outer diameter of a tubular core A. Numeral 15 indicates a third winding roller which is moved toward and away from the roll B, for example, by oscillating arms 15A.

A roll B in the process of formation is tangent to and in contact with the two cylinders 11 and 13 and with the roller 15, which rotate according to the arrows depicted thereon in the drawing for causing the winding of web N. The web N, after leaving the perforation station 1, passes around a turning roller 17 and describes, beyond said roller 17, a trajectory N1 which crosses the nip I by tangentially reaching the lower winding cylinder 13 to wind itself on the log B. Thus it is slightly spaced below the winding cylinder 11, which rotates in a direction opposite to the direction of advancement of the fed web N, as can clearly be seen in FIG. 1.

After the formation of the log B with the desired length of web N (and in particular with a pre-determined number of sheets defined between successive perforations formed by perforating station 1) it is necessary to separate the web from the formed log B. This is accomplished by tearing the web between the tail end of the web-like material wound on the log B, and the leading end of the web to be wound on the new core inserted into the nip I, thus beginning the winding cycle again.

A core arriving from the supply system 3, 5, and 9 is positioned, in a well-known manner at Ao so as to be ready for its insertion into the nip I being moved in the direction of arrow fI by a suitable pusher 18. It should be noted that the core is moved from position Ao into the nip I in such a way that the portion N1 of web N is disposed between the core which is being inserted and the upper winding cylinder 11. Thus the web comes into contact with the cylinder 11 only during the insertion of said core Ao.

The core is inserted into the nip I so as to engage the web in the portion N1 and to contact both with the lower and the upper winding cylinder 13 and 11. At that position (A1 in FIG. 2), the core begins to rotate in a counterclockwise direction (looking at the drawings) i.e., in the direction imparted by the rotating surfaces of the two cylinders 11 and 13.

This first causes the paper to tear in a portion between the paper pinching line between the cylinder 11 and the core A at position A1 and the pinching line between the log B and the winding cylinder 13. This is because the paper is pulled back by the cylinder 11 and the core (which begins to rotate) with respect to the direction in which the web N has been fed. Secondly, the leading edge of the paper web, formed by the above-mentioned tear, is pressed against the core at position A1, which is rotating in the direction indicated in FIG. 2, so as to be secured, by the adhesive, onto the surface of said core at position A1. It thus follows that the log B just formed may be moved away in the direction of the arrow in FIG. 3. The core at position A1 causes the initial winding of the paper coming from the trajectory N1 as shown in FIG. 3. This gives rise to an initial folding P which is completed by the wedging of the leading end material of web N1 between the core at position A1 and the lower winding cylinder 13, as can be seen in FIGS. 3 and even more so in FIG. 4.

The winding of the paper material on the new core at position A1 thus begins. The core then advances slowly from position A1 towards the roller 15 which, in the meantime, with the moving away of the log B already formed (see FIG. 3), is drawn close to the nip between the winding cylinders 11 and 13, so that the new core A1 is progressively brought in contact also with roller 15. This starts the winding under the conditions already indicated with reference to FIG. 1 for the core A and for the formation of the new log B.

Since it is possible to phase the operations of core insertion from position Ao to position A1 with respect to the position of the perforations carried out at the perforating station 1, it is also possible to perform the core replacement operation and thus the tearing of the paper web in the portion between the pinching point exerted by the cylinder 11 and by the core A1 and the pinching point between the roll B and the cylinder 13. This provides a given number of paper sheets wound and accumulated over the log B, the length in which the tear takes place being relatively short to ensure that only one perforation is present thereacross at the moment of the tear. It is thus possible to establish the exact number of sheets of paper which are included in the amount of wound material for the formation of a log or roll B, and also to preset the tear in correspondence of one perforation.

At the moment the paper material comes in contact along the trajectory N1 with the winding cylinder 11, owing to the pushing against it of core A1 inserted into the nip I, the web tends, in this trajectory N1, to become slack due to its moving backwash, with respect to the advancement direction, caused by the contact between cylinder 11 and core A1, as already mentioned. It is thus desirable to control the paper web during this stage of the core replacement cycle. This can be achieved in several ways.

According to FIGS. 1 to 4, a system of nozzles may be provided which blow air, as indicated in the drawing, so as to maintain some tension in the paper material against which the pneumatic thrust, suitably adjustable by the rate from a row of said nozzles 19. This system is particularly versatile and practically free from any inertia effect.

Figure 6:
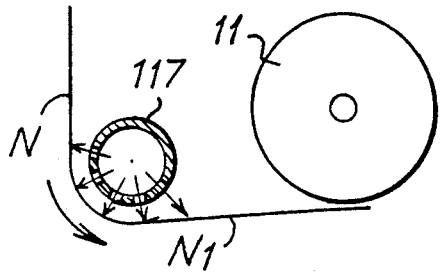

According to another solution, schematically represented in FIG. 6, the turning roller 17 is replaced by a manifold 117 supplied with air under pressure to create air cushion around said manifold to achieve both the turning of web N towards the trajectory N1 as well as a pneumatic-operated tensioning effect similar to the one obtained by the row of nozzles 19 of the preceding example. The manifold 117 may be fixed with the holes disposed only in the zone of the turning of the web N towards the trajectory N1, or it may rotate and may have the holes located throughout its entire cylindrical surface.

According to another embodiment shown in FIG. 5, a bar 217 may be provided, which replaces the turning roller 17, able to exert an electrostatic effect, for example, for the attraction of the paper web N which slides thereon in the zone of its contact towards the trajectory N1. In this case, the web, in its trajectory N1, tends to follow the bar 217 (which provides a limited obstacle to its moving away due to said electrostatic effect) thereby ensuring the slight tensioning of the web in the trajectory N1. Alternatively, the electrostatic effect might be accomplished by a repulsion effect and, in this case, there will be obtained a tensioning producing the same result as with the air blown by the manifold 117 in the schematic drawing of FIG. 6.

The tensioning system, such as the one indicated by 19 or other, may be disposed also for acting upstream of the turning cylinder 17 or of the perforating station 1 as well.

Figure 7:
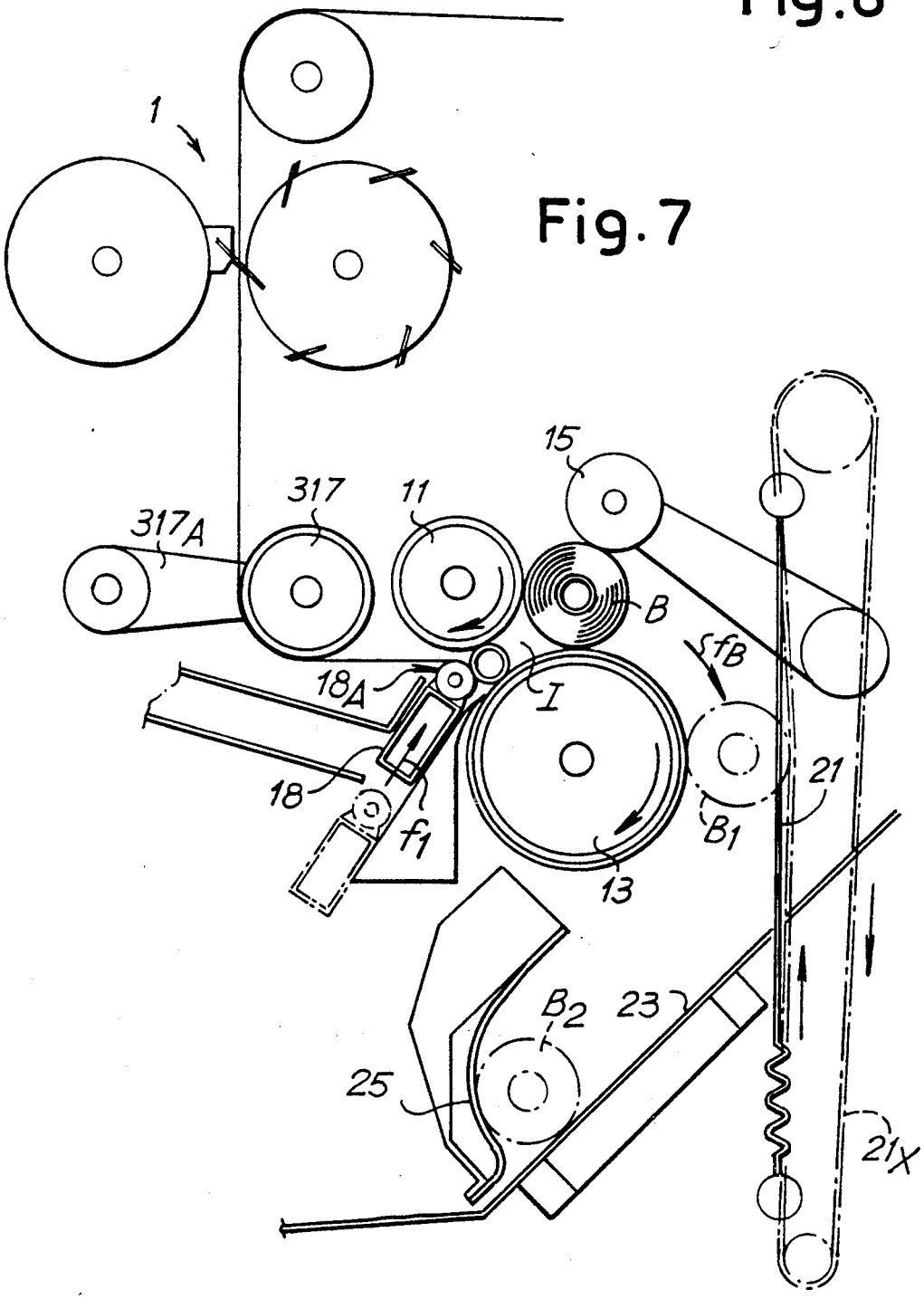
FIG. 7 shows a modified version of the embodiment of FIGS. 1 to 6.

According to the embodiment of FIG. 7, in order to achieve the tensioning of the web-like material, in place of one or the other of the above mentioned movable systems, a turning roller 317 may be provided such as the one mounted on oscillating arms 317A, to acieve the tensioning by means of an idler-roller tensioner.

FIG. 7 also shows a system for moving the log B away from the winding zone created between the cylinders 11 and 13 and the roller 15. It is useful to point out that the cylinder 13 rotates always in the direction of the arrow depicted thereon in the drawing even though, in order to remove the log B it may be subjected to temporary speed changes with respect to the rotation speed of the winding cylinder 11 and/or of roller 15. An elastic belt 21 is provided at a distance from the periphery of the lower winding cylinder 13 which can be adjusted so as to be slightly smaller than the outer diameter of the formed log B. The log B falls in the direction of arrow fB from the winding space down to the interspace between the cylinder 13 and said belt 21, and is made to rotate and roll further, always ensuring that the rolling is always in the same direction as the winding of the web-like material on the core.

From this position, indicated by B1, the log falls onto an inclined plane 23 and may be kept temporarily in a position B2 by a barrier 25, to be timely moved away therefrom afterwards and directed to further treatments and workings. In order to reduce or control the speed of fall of the roll or log B1, a series of closed ring-like belts may be provided in place of the elastic belt 21 moving in a direction opposite that of the contacting part of the log as indicated by 21X in FIG. 7 with a dash-dot line.

FIGS. 8 to 11 show a diagrammatical representation of a rewinder which is operatively equivalent, but inverted, with respect to the one shown in the preceding figures. The web N passes through the perforating station 51 which carries out the transverse perforations defining the individual sheets of papers. Numeral 53 indicates the reservoir of cores A, which are guided along guide means 55 to the winding group 57 after passing a wetting adhesive station generally indicated by 59. Numerals 61 and 63 indicate the two upper and lower winding cylinders (similar to those indicated by 11 and 13 of the preceding exaple), which define therebetween the nip I wherein a core must be inserted in the direction of arrow fI from dwell position Ao. In this example, the web trajectory N1 goes through the nip I thus causing the web to come in contact with the upper winding cylinder 61 and the log B in the process of formation. It remains at a slight distance from the surface of the winding cylinder 63 which rotates according to the arrow depicted thereon in the drawing, so as to have a peripheral advancement direction opposite to that for the feeding of web N1. The conditions are exactly equivalent to those between the cylinder 11 and the web N1 in the example of FIGS. 1 to 4.

Figures 8, 9, 10, 11:
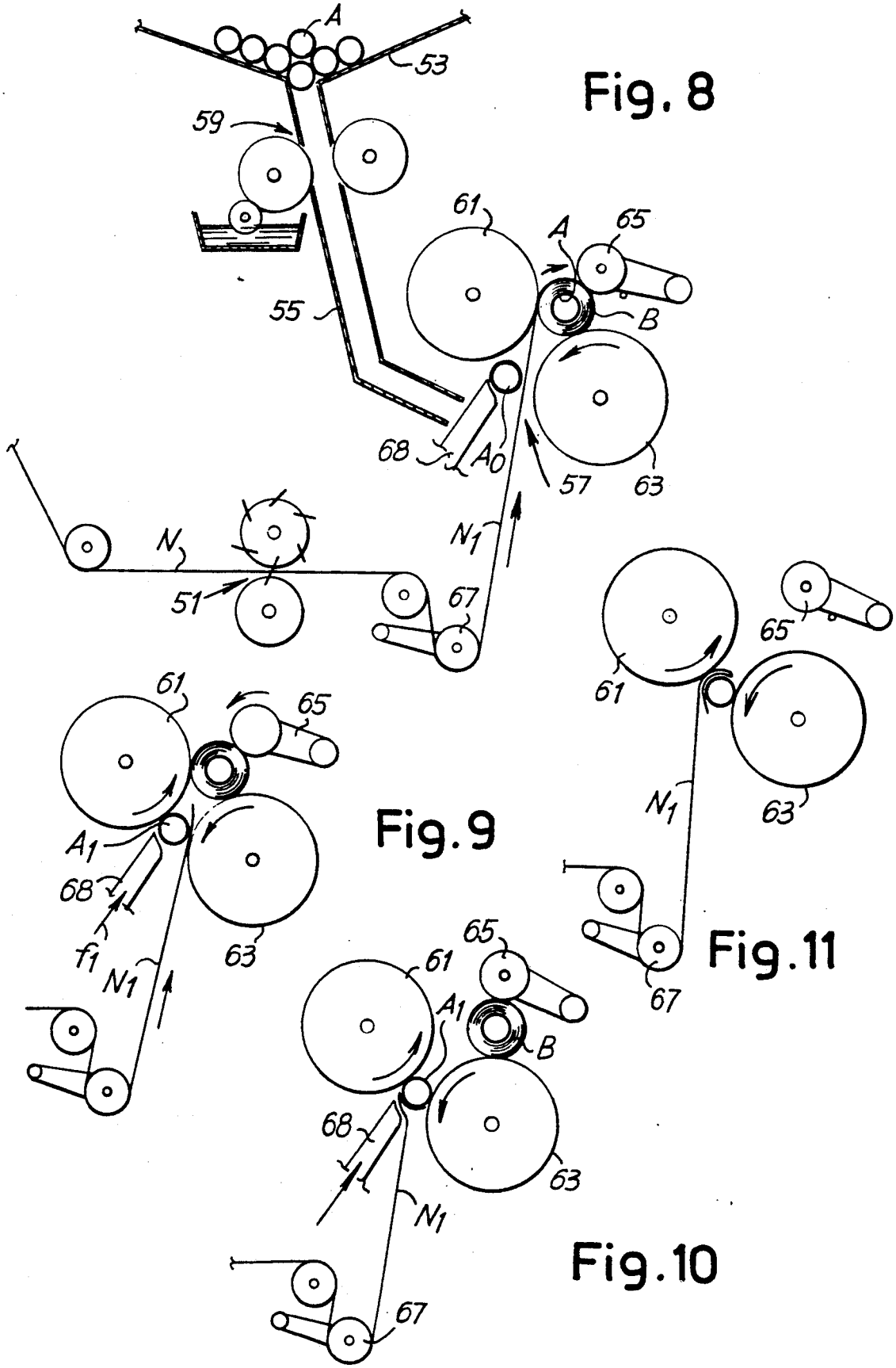
FIGS. 8 to 11 show, in four successive stages yet another embodiment of the invention.

Numeral 65 indicates the movable winding roller which defines the winding space together with cylinders 61 and 63. Numeral 67 indicates a web-turning device for advancing the web along the trajectory N1. Numeral 68 indicates a means for inserting a core in the nip I. In this case, the core which is inserted in the nip I moves the web portion N1 against the cylinder 63 thereby causing the breaking of the web between the zone of contact of the log with cylinder 61 and the zone of contact between core A1 and cylinder 63. The core inserted in position A1 is rotated clockwise (for an observer looking at FIGS. 9 and 10) and, due to the presence of the adhesive, said core engages the leading end of the web which is about to wind itself on said core. The leading end of the web along the trajectory N1 is pressed and thus glued on the core by the pressure exerted thereon by cylinder 63, and is initially folded by the rotation of the core at position A1 (FIG. 10). The folding is completed by wedging the web between the core A1 and the upper winding cylinder 61. From this position, the winding of the web-like material starts onto the just inserted core A1, while the log B is moved away in a usual way. Arrangements similar to those described in the preceding examples may be adopted to ensure the regular development of the trajectory N1 of the web-like material reaching the nip I between the two cylinders 61 and 63 during the steps shown in FIGS. 10 and 11.

According to a modified embodiment, the pusher 18 may be provided with shaped profiles, and/or thrust rollers may be provided such as those indicated by 18A in FIG. 7, so that, when winding up of the web onto the newly inserted core A1 starts, said web is moved and guided by the same pusher which moves back progressively. This makes it possible to avoid sudden variations in the paper tensioning.

A further way to ensure the regularity of the paper trajectory, as an aid to, or as an alternative to the above arrangements 19, or 117 or 217, can be achieved by exploiting the elasticity of the paper which can be tensioned to a greater extent through the temporary acceleration of roller 13 or 63, which acceleration is already required for removing the roll B just formed. This greater tensioning makes up for the slack, which is determined by the contact between the core and the cylinder 11 or 61.

The adhesive may be distributed over the cores by group 9 or by group 59 or the like, either in the form of annular zones suitably spaced apart on each core, or by a longitudinal continous strip or a strip suitably interrupted at spaced zones, to ensure glueing the leading end of the web on the core. Suitable position phasings of the core insertion and of pushers 18 or 68 for the insertion of cores into the nip I may be adopted in a manner well-known in order to avoid the accumulation of adhesive onto the pushers possibly coming in contact with the adhesive being spread over the core.

The advantages of an arrangement like the one above described are evident. An extreme reliability is obtained as far as the pinching or grip of the leading end of the web onto the core, even at relatively high operation rates. The tear of the web-like material is carried out in a very regular way as it is accomplished through a roller member rotating opposite to the feed direction of the web-like material. The transverse perforation performed on the web-like material may be easily synchronized with the core introduction, so as to tear the web along a desired perforation and thus obtaining the winding of a given, precise and constant number of sheets or segments of web-like material defined by the perforations on each log.

It is possible to adjust the distance between perforations even during working, and it is also possible to easily adjust the number of perforations, that is, the number of sheets of material that may be wound on each log. It must be pointed out that the number of sheets to be wound over a same log, i.e., the number of perforations present in each log, may be adjusted one-by-one and not according to groups, a limitation in rewinding machines currently on the market. These and other objects and advantages will be evident to those skilled in the art by reading the above description.

It is understood that the drawing shows an exemplification given only as a practical demonstration of the invention, as this may vary in the forms and dispositions without, nevertheless, coming out from the scope of the idea on which the same invention is based. The possible presence of reference numbers in the attached claims has the purpose to facilitate the reading thereof, reference being made to the description and the drawing, and does not limit the scope of the protection represented by the claims.

Having thus described my invention, what I claim as new and desire to protect by Letters Patent are the following:

1. A rewinding machine for the formation of small rolls or logs of segmented web material, said machine including:

an upper winding cylinder (11, 61),
a lower winding cylinder (13, 63),
a nip (I) between the upper and lower cylinders,
a third roller (15, 65) which defines with said two cylinders, a space for the winding of a roll (B),
pusher means (18, 68) for the insertion of individual cores Ao into said nip (I),
means (9, 59) for applying adhesive to the cores,
said rewinding machine being further characterized in that a web (N1) is fed across the nip (I) between the two winding cylinders (11, 13, 61, 63),
the direction of movement of web (N) as it arrives at said nip (I) being opposite to the direction of rotation of cylinder (11, 63) the pusher means moving the new core into engagement with the running web to contact the cylinder (11, 63),
thereby causing the web to tear upon said insertion,
the leading edge of the web being applied to the core by means of adhesive applied by means (9, 59) and being folded by wedging it between the core (A1) and the lower winding cylinder (13, 61).

2. The machine of claim 1 wherein the relative peripheral speed between said cylinders is cyclically variable.

3. A rewinding machine according to claim 1 wherein the means (18, 68) for the insertion of the core into the nip between the winding cylinders (11, 13, 61, 63) are provided with a leading edge or rollers (18A) able to move the web as it begins to be wound onto the inserted core A.

4. A rewinding machine according to claim 1, including tensioning means acting on the web-like material (N1) in the nip (I) between the two winding cylinders.

5. A rewinding machine according to claim 4 wherein said tensioning means are pressurized air means (19, 117), acting on the web in advance of the nip.

6. A rewinding machine according to claim 4, wherein said tensioning means (217) exert an electrostatic effect of attraction or repulsion on the web in advance of the nip.

7. A rewinding machine according to claim 4 wherein said tensioning means is an idler-roller (317).

8. A rewinding machine according to claim 1, wherein the lower cylinder (13) is accelerated for removing log (B1) just formed, and causing an increase in the tensioning of the web thereby taking up the slack in the web.

9. The method for winding rolls of web-like material on a core (A, A1), including providing a first and a second rotating winding cylinder (11, 13; 61, 63) and a mobile winding roller (15, 65), and a winding space created therebetween, providing a nip (I) between the first and the second rotating winding cylinders for the insertion of the core (A1), feeding a web of ribbon-like material through the nip (I), moving the core close to the surface of the first winding cylinder the surface of which rotates in the direction opposite to the direction of movement of the web, applying adhesive onto the core, inserting the core into the nip, pinching the web between the core and the surface of the first winding cylinder whereby to tear the web, passing the leading edge of the torn web in a folded condition between the core and the second winding cylinder, and pulling the leading edge of the torn web away from the log just formed.

* * * * *